US008069531B2

(12) United States Patent
Ruston

(10) Patent No.: US 8,069,531 B2
(45) Date of Patent: Dec. 6, 2011

(54) DECK CLEANING TOOL

(76) Inventor: Walter A. Ruston, Dallas, OR (US)

( * ) Notice: Subject to any disclaimer, the term of this patent is extended or adjusted under 35 U.S.C. 154(b) by 998 days.

(21) Appl. No.: 11/926,248

(22) Filed: Oct. 29, 2007

(65) Prior Publication Data

US 2008/0256737 A1 Oct. 23, 2008

Related U.S. Application Data

(60) Provisional application No. 60/913,332, filed on Apr. 23, 2007.

(51) Int. Cl.
*A47L 9/06* (2006.01)

(52) U.S. Cl. ..... 15/401; 15/93.1; 15/93.4; 15/415.1; 134/21

(58) Field of Classification Search ..... 15/300.1, 15/344, 415.1, 401, 93.1, 93.4, 246.2; 134/21; *A47L 5/14*

See application file for complete search history.

(56) References Cited

U.S. PATENT DOCUMENTS

| | | | | |
|---|---|---|---|---|
| 4,045,840 | A * | 9/1977 | Johansson | 15/397 |
| 5,666,683 | A | 9/1997 | Gairdner | |
| 6,047,437 | A * | 4/2000 | Suzuki | 15/401 |
| 6,205,608 | B1 | 3/2001 | Bowen | |
| 6,757,938 | B1 | 7/2004 | Lee | |
| 7,805,805 | B2 * | 10/2010 | Loveless | 15/401 |
| 2009/0126649 | A1 * | 5/2009 | Porter et al. | 119/601 |

* cited by examiner

*Primary Examiner* — David Redding
(74) *Attorney, Agent, or Firm* — Peter A. Haas, Esquire LLC

(57) ABSTRACT

An improved deck cleaning tool includes a rigid blade with a sharply angled front end and adapted to dislodge debris build-up commonly found between planks of outdoor decks is supported by a plate having an aperture connected to a rigid and hollow conduit having a handle at its distal end. The distal end further adapts to couple to a common shop or wet/dry vacuum cleaner.

15 Claims, 8 Drawing Sheets

FIG. 1
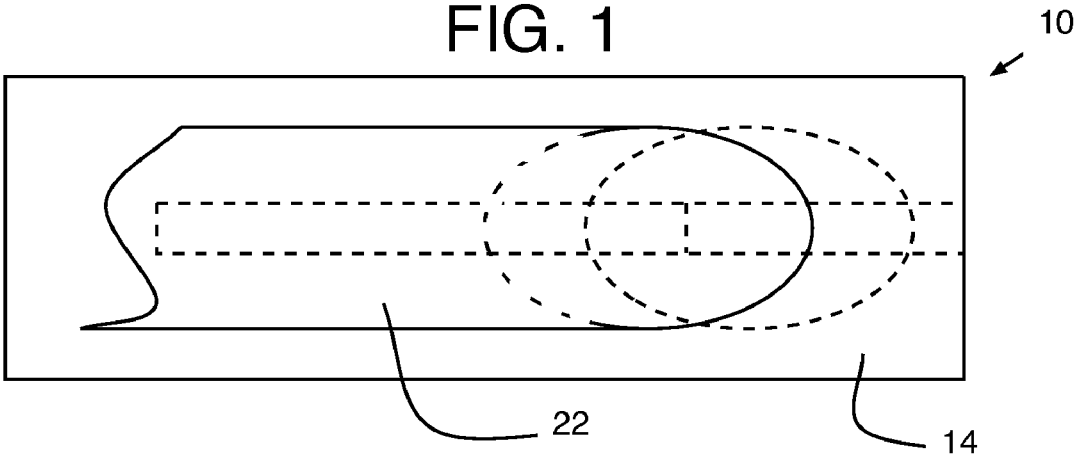
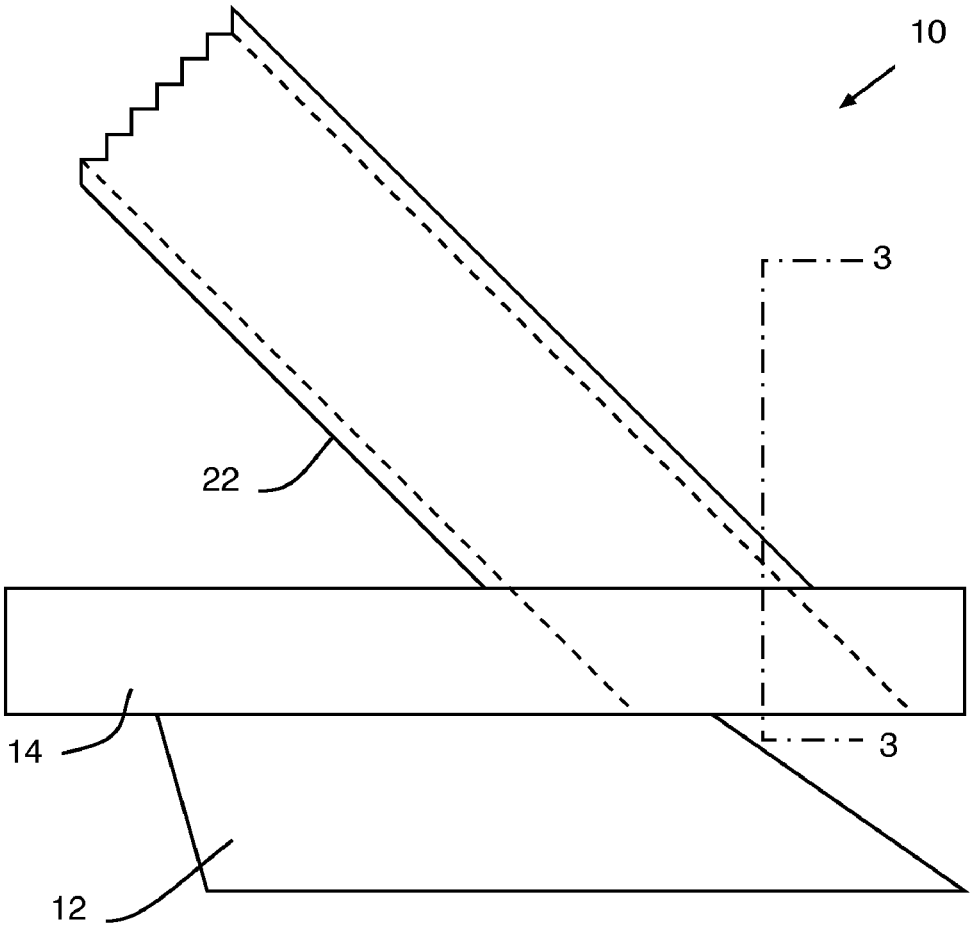
FIG. 2

DECK CLEANING TOOL

PRIORITY CLAIM

This present application claims benefit under 35 U.S.C. Section 119(e) of U.S. Provisional Patent Application Ser. No. 60/913,332, filed on 23 Apr. 2007, the disclosure of which is expressly incorporated by reference for all purposes.

BACKGROUND

This invention relates to a tool for removing debris between adjacent planks of decks and similar structures.

Outdoor decks typically include wood or composite planks arranged in a generally parallel layout with a narrow gap or crevice between adjacent planks. The gap allows expansion space for wood planks and facilitates water drainage. This gap, however, commonly clogs with debris including leaves, pine needles, and other matter. The build-up of debris between the planks accelerates deterioration of the planks, causes the deck surface to become slippery, and inhibits water shedding. Further, periodic maintenance of the deck, typically consisting of painting or staining, requires complete removal of the debris build-up. Thus, a need remains for a tool designed to efficiently and completely remove debris and build-up between deck planks.

The methods and devices of the prior-art address this problem with varying success. One common approach uses pressurized water to forcefully evict debris from the gap between deck planks. This requires a cumbersome mechanism that receives a supply of water from an outdoor water tap, a nozzle apparatus and a pressurizing means. The pressurizing means typically includes either an internal combustion engine or an electric motor to compress the water. One significant limitation of this approach is that the high-pressure fluid stream damages the surface of the deck by exploding the cell membrane of the wood deck planks, or by removing a surface treatment of stain, oil, paint or other covering. Further, the high-pressure wash stream poses a safety concern to the user and care must my used to avoid contact with the effluent stream because severe injury can result. And, when a combustion engine provides the pressurized stream, additional hazards include the storage, transportation and evaporation of a combustible and hazardous chemical and pollution of the air during use.

Another approach to removing debris build-up between deck planks includes a device described by Gairdner in U.S. Pat. No. 5,666,683 issued on 16 Sep. 1997. The Gairdner device includes an elongated, hollow and lightweight shaft with a tine at one end and a handle at the opposite end. The tine, sized with a rectangular cross-section and width of a size to fit between the planks of a deck, provides a flat engagement surface arranged at an first angle relative to the horizontal deck planks and a second angle relative to the shaft. An operator locates the tine between the deck planks and either pulls or pushes the handle parallel to the arrangement of deck planks. This causes the tine to contact and loosen the debris. However, one limitation of this design includes the dislodged debris may be extracted from the gap between planks only to be deposited on the surface of the planks, which requires a secondary operation to remove it. One plausible secondary operation would include sweeping or using pressurized water to clean the surface—however, both of these techniques re-introduce the debris between the planks and may cause the debris to become re-stuck.

Another approach, described by Bowen in U.S. Pat. No. 6,205,608 issued on 27 Mar. 2001, includes a device having a blade attached to a handle and a pair of wheels for contacting the upper planar surface of the deck planks. Yet another attempt, described by Lee in U.S. Pat. No. 6,757,928 issued on 6 Jul. 2004, includes a device consisting of a pole pivotably mounted to a cleaning head. In both the Bowen and Lee references, debris build-up is removed between the planks; however, both devices simply dump the debris on top of the deck surface necessitating a remedial clean up to remove the deck. Further, the remedial clean up often consists of pressure washing or sweeping. And, this inefficient remedial step results in a re-deposit of the debris during sweeping or damage to the deck from the use of pressurized water.

Thus, there remains a need for a deck-cleaning tool that not only adequately fits between the deck planks, but does not re-deposit the debris build-up on top of the surface of the deck. Moreover, such an improved deck-cleaning tool should eliminate a remedial cleaning operation.

SUMMARY OF THE INVENTION

In one embodiment, the present invention consists of an improved deck cleaning tool having a blade sized to fit between the generally parallel planks common to most outdoor decks made of wood or composite. The blade is angled to easily wedge under any debris lodged between planks, and when motivated in a forward or direction parallel to the planks, the blade's angle forces the lodged debris generally upward. The blade couples to a plate member, which supports the blade in an angled position relative to the planar deck and the plate member further being arranged generally parallel to the planar deck surface. The blade is motivated by a handle of sufficient length to provide comfortable operation by a person. In addition, the handle includes a generally hollow interior with an open distal end and an open proximal end. The proximal end couples to the plate member, and a through-hole disposed on the plate element aligns with the hollow handle portion and provides an opening near the top of the blade. The distal end of the handle adapts to selectively couple to a vacuum hose commonly used by a shop or "wet-dry" vacuum cleaner as generally understood in the art.

Accordingly, when suction—created by the operation of the vacuum cleaner—is applied to the handle and the blade is simultaneously motivated relative to the planks on the deck, the debris is both dislodged and sucked into the vacuum cleaner's chamber. The present invention, therefore, eliminates a subsequent cleaning operation, overcoming the limitations of the prior-art. Other advantages of the present invention include:

- A simple mechanical blade, absent of moving parts, easily fits between deck planks but efficiently forces debris build-up upward;
- Suction provided by a readily available vacuum device, such as a shop vac or a wet/dry immediately removes the uplifted debris;
- Standard coupling means enable quick, selectable, and removable attaching of the tool to a standard vacuum;
- Elimination of remedial clean ups—no sweeping or pressure washing required;
- Economical to produce, own and use;
- Lightweight;
- Use of simple but rugged construction techniques and materials; and
- Providing an easy to repair and maintain tool.

A preferred embodiment includes a tool consisting of an assembly of the different parts, i.e. base plate, blade and vacuum tube made of wood or plastic or a combination, A preferred way of making the deck cleaning tool will most is by injection molding the entire apparatus with a material like abs plastic with the blade attached later in a groove provided by the molding process so that, in a case of blade breakage it can be replaced.

A preferred method of use includes after attaching it to a vacuum and then simply inserting the blade into a groove in the deck and with short forward and backward strokes, moving the tool, inching forward to the end of the groove being cleaned, then repeating the process till all groves are cleaned.

The blade could be made of a composite material but preferably be made of mild or stainless steel.

DRAWING

FIG. 1 is a top view of one embodiment according to the present invention.

FIG. 2 is a front view of the embodiment of FIG. 1.

DESCRIPTION OF THE INVENTION

Figure 4:
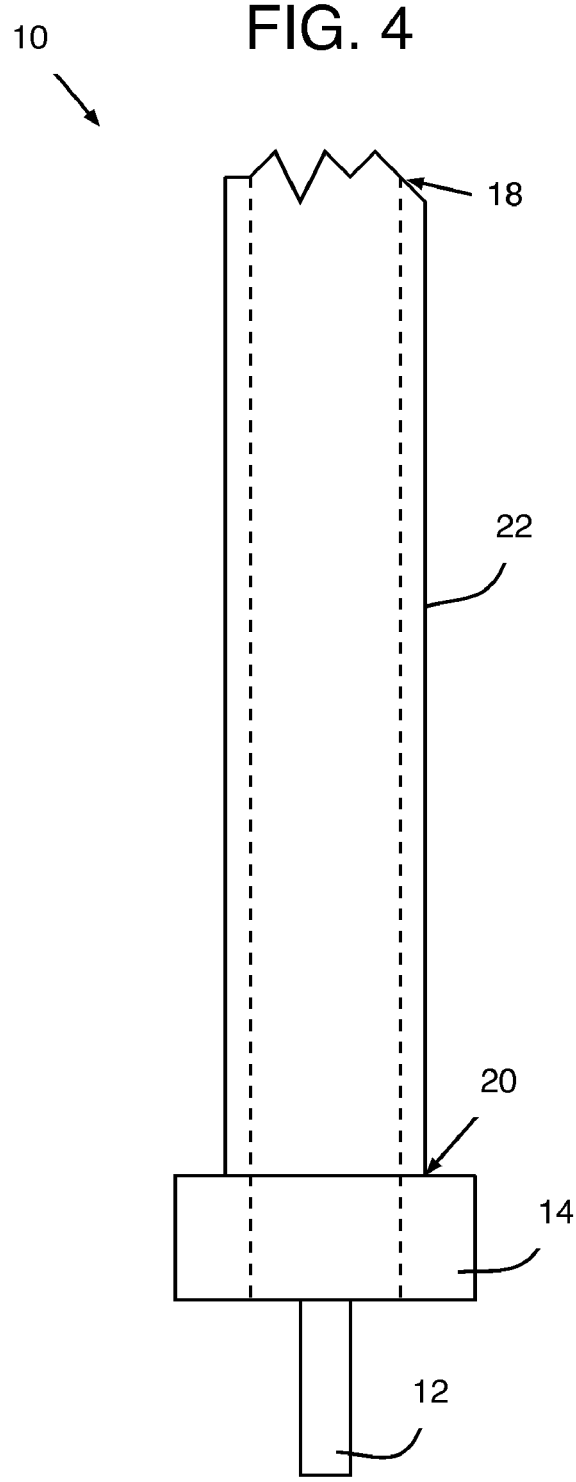
FIG. 4 is a right-side view of the embodiment of FIG. 1.

Possible embodiments will now be described with reference to the drawings and those skilled in the art will understand that alternative configurations and combinations of components may be substituted without subtracting from the invention. Also, in some figures certain components are omitted to more clearly illustrate the invention.

FIG. 1 and FIG. 2 illustrate a top view and a side view, respectively, of one possible embodiment of the present invention consisting of a deck cleaning tool 10. The tool includes a rigid and hollow conduit member 22 coupled to a plate member 14 at a top face of the plate member to form generally about a 45-degree angle with the face; however, this angle is not precise—rather this angle provides for ease of use and convenience to the user when used to clean decks and a near vertical or 90 degree connection, a rotating connection or a near 180-degree connection would work, albeit with some loss of efficiency.

The plate member further carries a blade 12 arranged on a bottom face, opposite the top face. The blade 12 is relatively narrow compared to the plate member and the blade is further adapted for use to locate between deck planks of an outdoor deck as is commonly understood in this art. The blade is constructed of a material well-suited to loosen debris wedged between deck planks. Accordingly, a rigid plastic, carbon fiber, or metal, such as aluminum, steel, stainless steel, bronze, and the like are well-adapted for this use. The blade 12 couples generally perpendicularly to the bottom face of the plate 14, as would be well understood in this art. Additionally, the blade includes an angled front portion to better dislodge debris between deck planks; however, a blunt blade would work as well with, perhaps, some loss of efficiency but well within the scope, intent, and spirit of the present invention.

Figure 3:
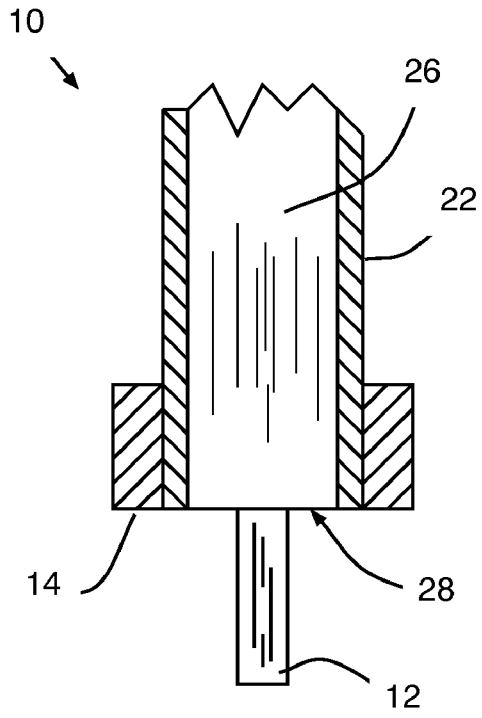
FIG. 3 is a partial cross-section along the line 3-3 of FIG. 2.

FIG. 3 and FIG. 4 further illustrate the tool 10 of FIGS. 1 and 2 and highlight the arrangement of the hollow conduit member 22. The conduit member 22 includes a hollow chamber 26 extending from a proximal end 20 (defined as being adjacent to the plate) and an oppositely arranged distal end 18. The hollow chamber couples in fluid communication with an aperture 28 disposed on the plate 14. The aperture 28 extends from the top face of the plate to the bottom face, arranged in close proximity to the blade 12 and sized larger than the blade to enable debris from the deck to be sucked over the blade and through the aperture and into the chamber 26 when a vacuum is provided to the distal end 18 of the conduit 22. As the figures show, the round or oval aperture extends at an angle of generally about 45-degrees with horizontal plane of the plate; however, other combinations of aperture size, angle and shape will work equally well.

Although not precisely depicted in the various figures, it will be appreciated by those skilled in the art that the hollow conduit member 22 includes a handle or grip at the distal end. The handle enables a user to easily maneuver and hold the tool 10. The handle, moreover, does not interfere with the fluid flow path between the tool 10 and a user-supplied vacuum device such as a shop vac or a wet/dry vacuum cleaner well understood in this art. The handle further includes a coupling means for selectively attaching a standard vacuum hose to the conduit 22.

Figure 5:
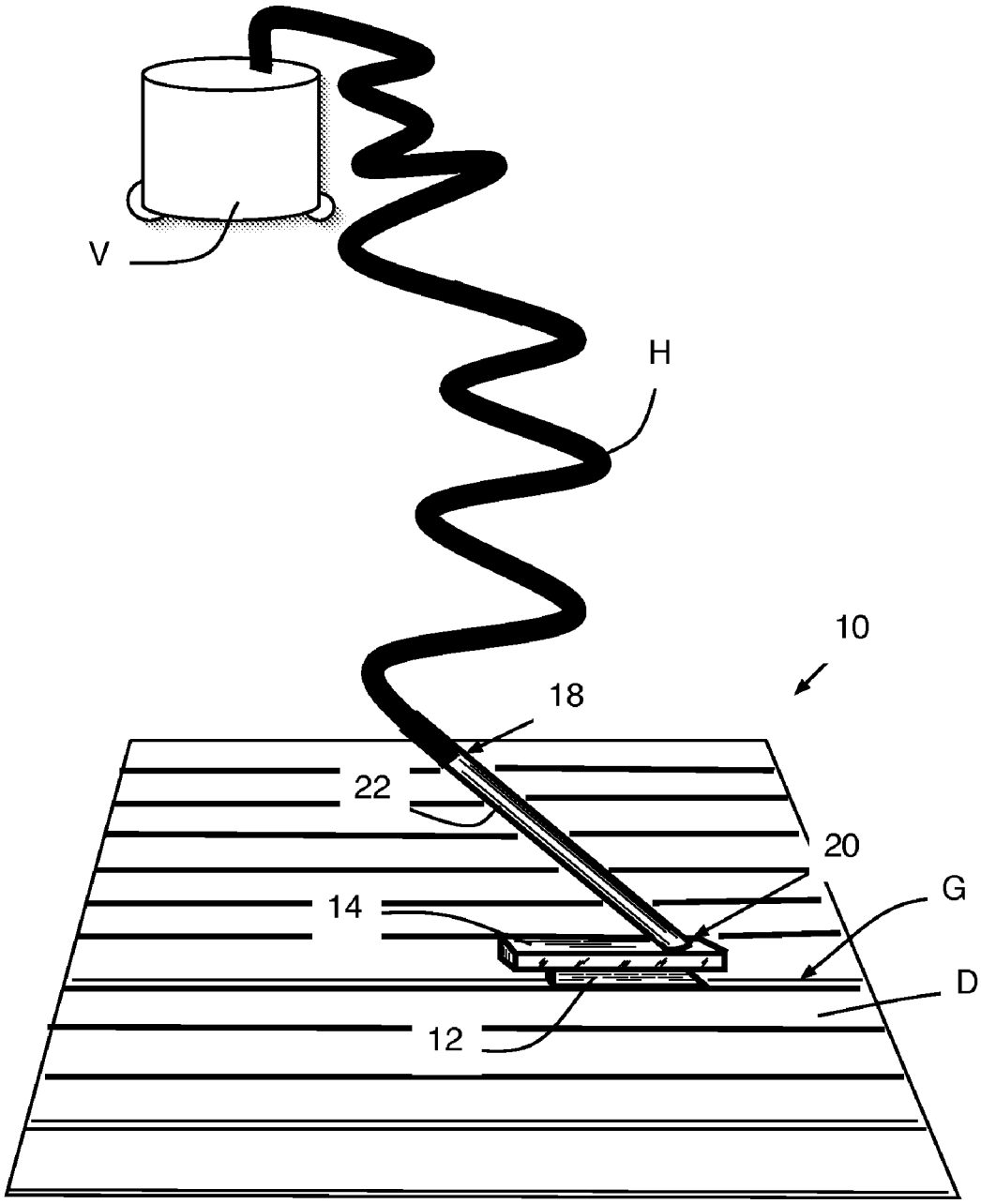
FIG. 5 is a representation of the embodiment of FIG. 1 in a possible environment of use.

FIG. 5 shows a typical and contemplated environment or application of use for the tool 10 according to the present invention. An outdoor deck includes an arrangement of deck planks D having a narrow gap G between each respective plank. The tool 10 includes a narrow blade 12 adapted to be inserted in the narrow gap G. A plate member 14, adapted to rest on top of the deck plank enhances the vacuum-induced fluid flow path between the user supplied vacuum machine V, via standard vacuum hose H, to the tool 10 and the deck surface. The rigid blade forces wedged debris out of the gap as the tool is motivated by the user exerting sufficient force on the handle portion of the conduit 22 to motivate the tool forward.

In one embodiment, the blade's leading edge includes an angle to better enable debris to be dislodged and further, the tool 10 includes an conduit 22 arranged in angled relationship to the plate 14 at about a 45-degree angle to more efficiently enable a user to motivate the tool along the gap of the deck.

Figure 6:
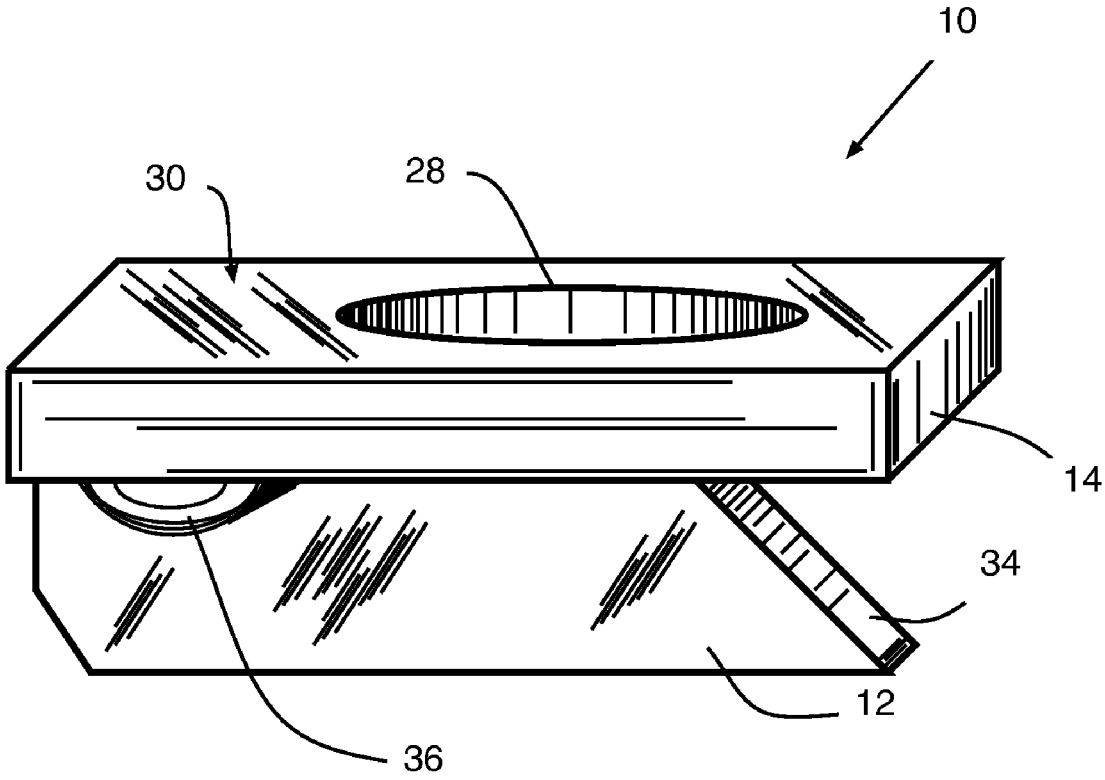
FIG. 6 is an offset frontal view of another embodiment of the present invention.
Figure 10:
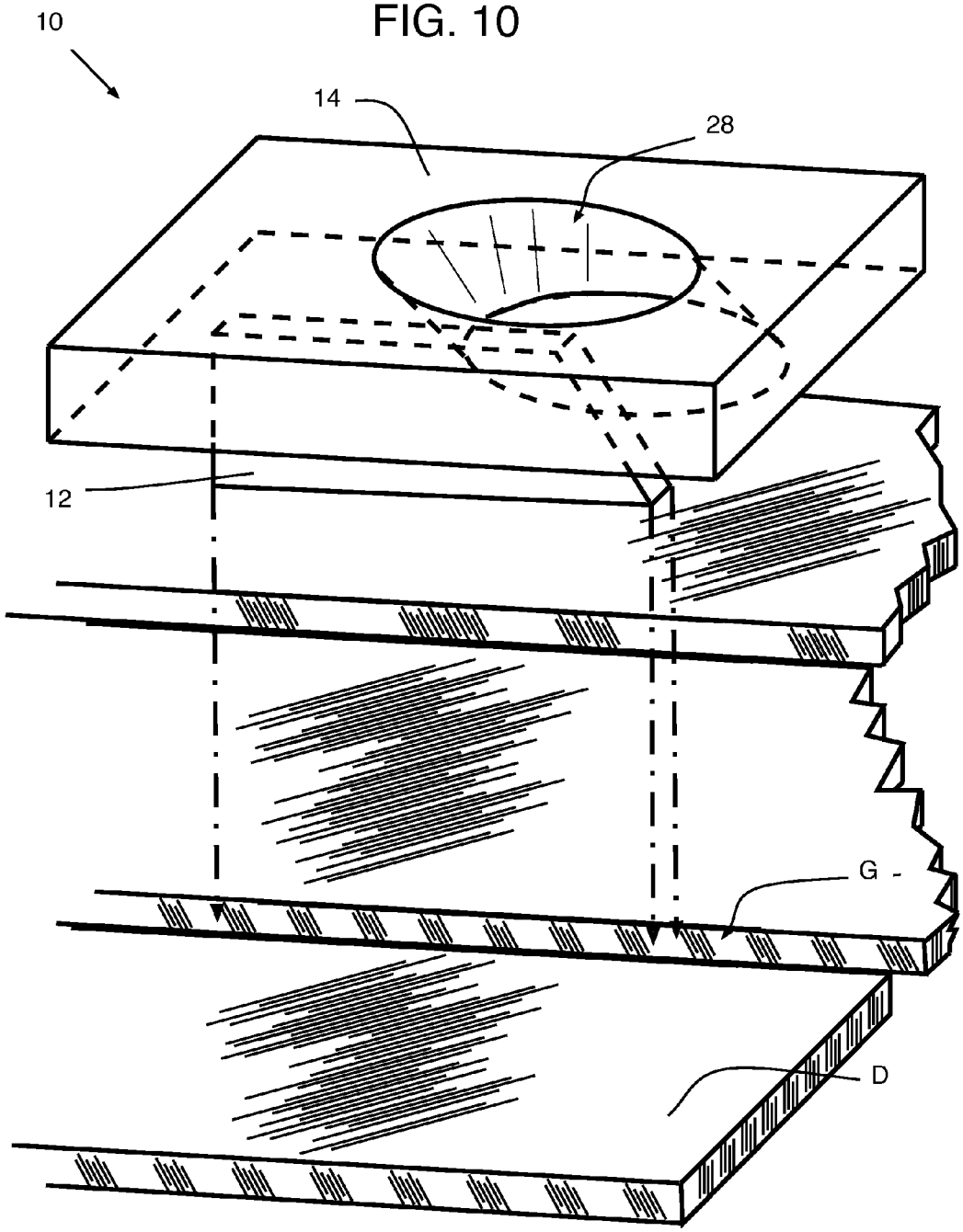
FIG. 10 is a perspective view showing the embodiment of FIG. 1 in one possible environment of use.

FIG. 10 details the relationship of the plate 14, blade 12, and aperture 28 with respect to a common deck arrangement of planks D having a gap G between planks. As FIG. 6 shows, for example, the plate 14—in one embodiment—includes a rolling element 36 such as bearings, wheels, and the like. As such, the plate need not rest directly on the deck surface to enable sufficient vacuum suction. Indeed, just as a conventional vacuum cleaner well understood in the art has a platform that rides on wheels or other similar friction-reducing rotary mechanism, so to can this tool's plate 14 can be adapted to include wheel mechanisms to facilitate travel across the deck.

In one possible embodiment, the present invention consists of a deck cleaning tool 10 includes a vacuum fluid flow passage consisting of a standard vacuum flex hose with a tapered friction fit connector at the distal end 18. This selectively couples to a standard shop vacuum cleaner with a simple slip or friction fit. Intermediating the distal end and a proximal end 20 is a rigid conduit 22 having a hollow interior center and is generally cylindrical having an inner diameter of about 1⅛-inches. This rigid conduit 22 terminates at the proximal end 16 locating adjacent to the plate member 14.

Figure 7:
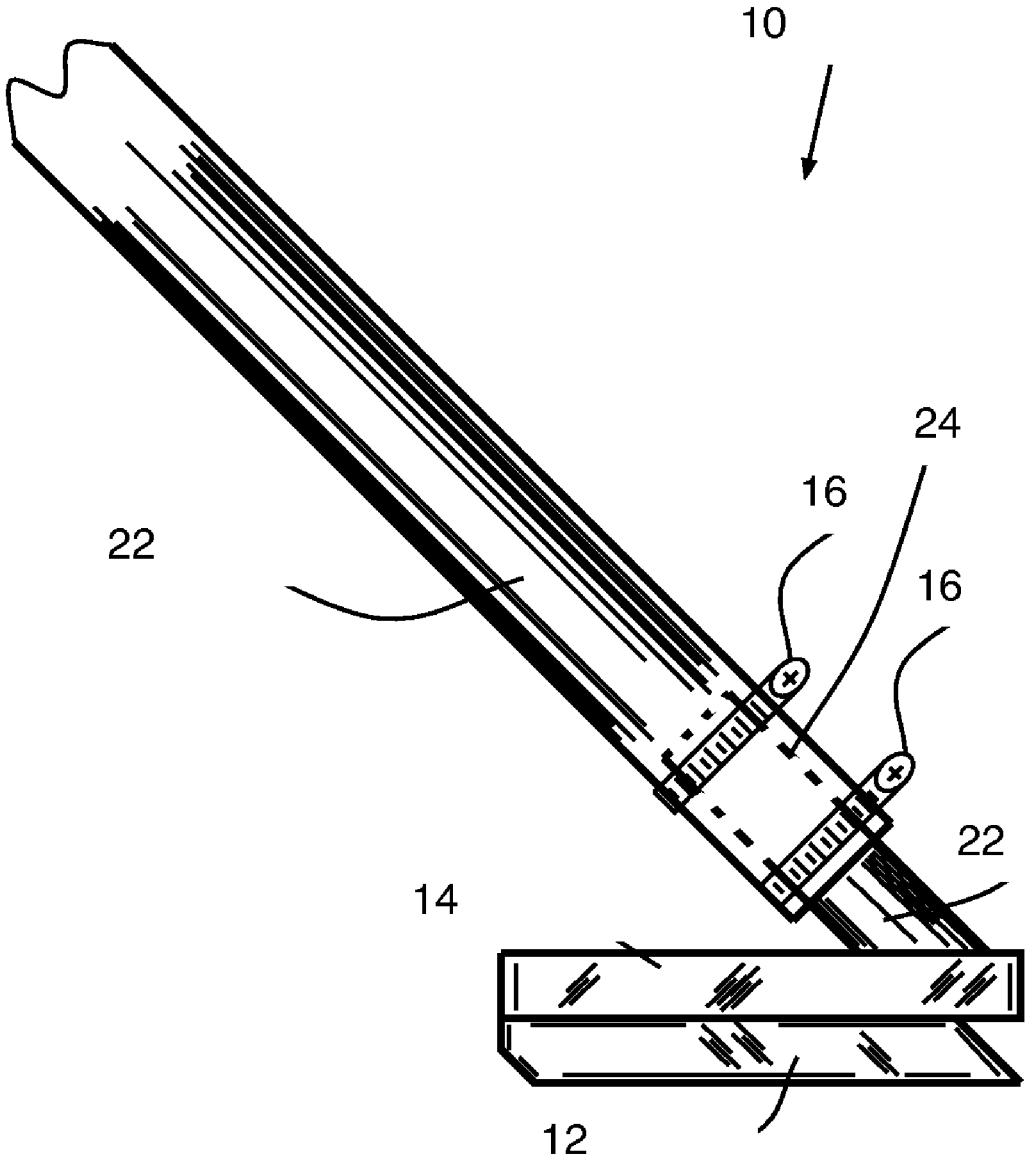
FIG. 7 is front view of the embodiment of FIG. 6.

FIG. 7 illustrates another embodiment of the present invention. The plate member 14 includes a main vacuum tube receiving member 24 extending at about a 45-degree angle from the top face 30 of the plate member 14. The receiving member 24 is generally oval in cross section, and matches the shape of the conduit 22. In this example, the receiving member has an outer diameter of about 1⅞-inches and can slip over the conduit 22 at the conduit's proximal end 20. Optional flex hose screw-type hose clamps 16 secure around the intersection of the proximal end and protruding receiving member to ensure a secure coupling of the conduit to the plate. A pair of hose clamps 16 locate about 3-inches apart from one another, the first clamp being located about 4½-inches from the top face 30 of the plate 14. The receiving member aligns in a 45-degree orientation with the aperture 28, which is oval in shape with a minimum diameter of about 1⅞-inches.

The top plate 14 is generally rectangular, and forms a three-dimensional rectangular box having a height of about ¾-inch, a length of about 6¾-inches, and a width of about 3-inches.

A blade 12 extends generally perpendicular from the bottom face 32 of the plate member 14. The blade include dimensions of about 6¾-inches long, about $1/16^{th}$-inch wide and about 1¾-inches in height. The leading blade edge 34 at its lowest point angles up and back at an angle of about 40-degrees to about 45-degrees so that the most forward and lowest point is in line with the leading edge of the plate 14. In this arrangement, a portion of the blade's leading edge 34 overlaps the aperture 28 in the plate 14. The blade couples securely to the plate by two mounting fasteners that extend through the plate 14. One suitable fastener includes a 3/16-inch×1/32-inch bolt with washer and nut. The blade extends through the centerline of the plate to faciliate assembly of the blade to the plate.

FIG. 6 shows another embodiment of the present invention, which consists of a crevice cleaning tool 10. The tool has a blade member 12 disposed generally perpendicular to a bottom face of a plate member 14. The plate member has an aperture 28 extending from the top face to the bottom face and creating a fluid-flow path from the bottom face to the top face 30.

The blade has an acutely sloped leading blade edge 34 arranged so that a top portion of the leading blade edge overlaps a portion of the aperture 28. Specifically, the blade edge 34 arranges at about a 45-degree angle relative to a to a bottom edge of the blade and wherein a portion of the blade edge overlaps a portion of the aperture 28.

Figure 8:
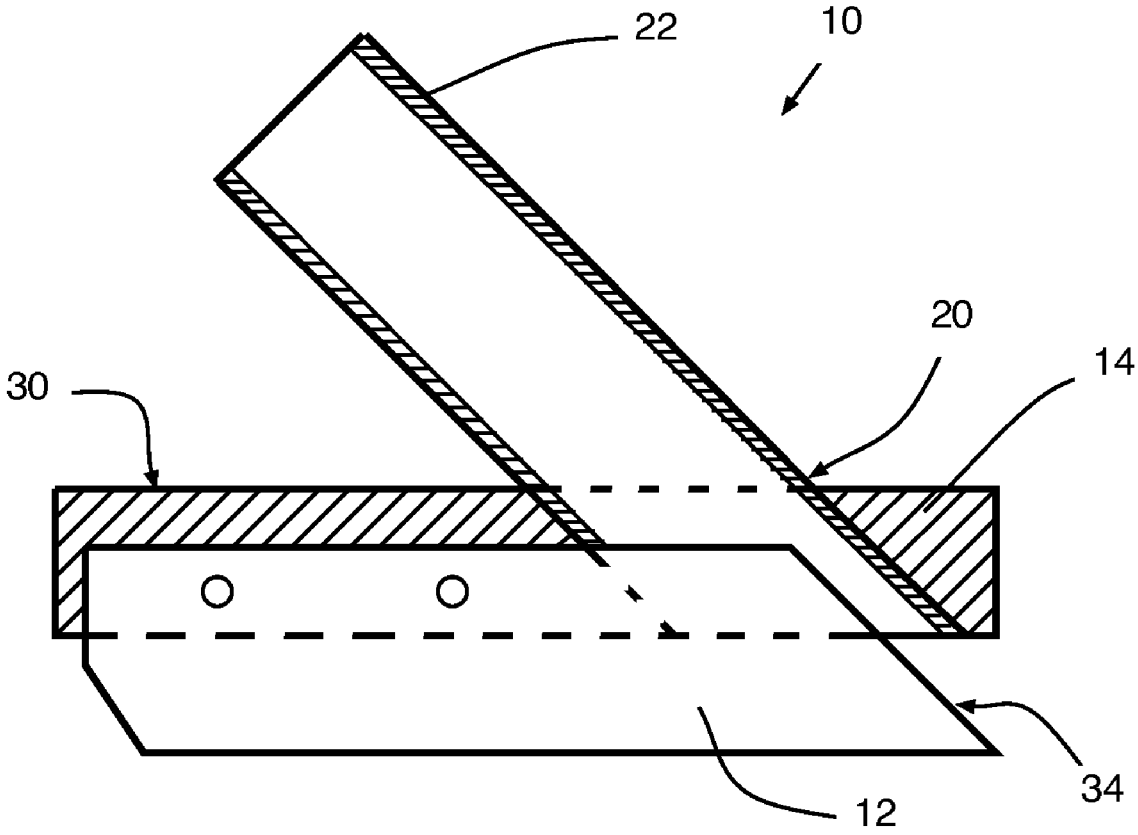
FIG. 8 is cross sectional front view showing a portion of the embodiment of FIG. 6.
Figure 9:
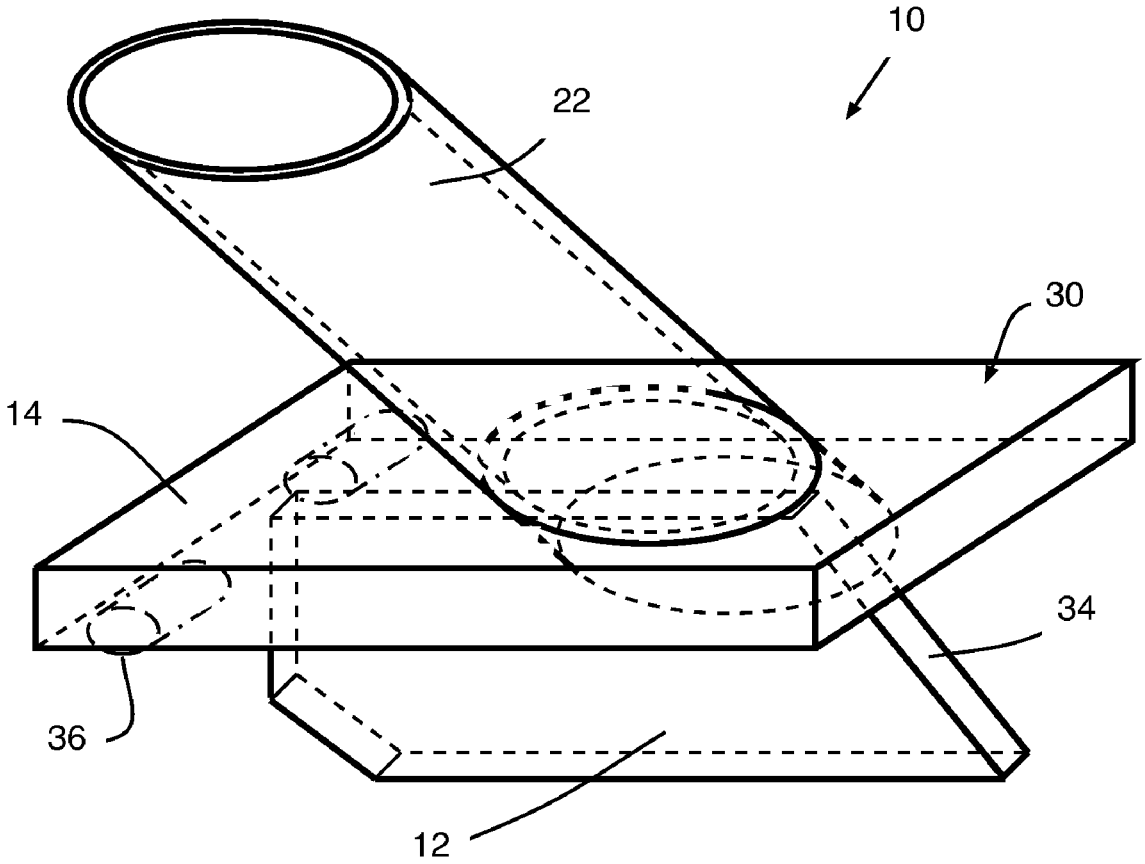
FIG. 9 is an offset frontal view of yet another embodiment of the present invention.

The aperture 28 includes a sidewall connecting and intermediate to an opening on the top face 30 of the plate 14 and a bottom face. The sidewall arranges generally perpendicular to the top face in one embodiment (as FIG. 6 shows). Alternately, as FIGS. 8 and 9 illustrate, the aperture 28 arranges on the top face 30 and couples to a corresponding opening on the bottom face by means of a sidewall having about a 45-degree angle relative to a plane defined by the bottom face.

Referring again to FIG. 6, the crevice cleaning tool 10 includes a rolling element 36 disposed adjacent to the bottom face. Alternatively, as FIG. 9 shows, the rolling element 36 consists of a pair of wheels arranged on the bottom face of the plate.

FIG. 7 shows another embodiment of the invention. The tool 10 includes a conduit member 22 consisting of a sidewall and oppositely arranged and open distal and proximal ends to form a hollow chamber, the proximal end coupled to the plate 14 and the hollow chamber further adapted to extend the fluid-flow path from the plate from the proximal end to the distal end.

Referring generally to FIGS. 6, 7, 8 and 9, the crevice cleaning tool 10 includes a conduit member 22 that includes means for providing rigid support of the hollow chamber. The conduit member further comprises a handle means for gripping the tool, the handle means arranged adjacent to the distal end. The conduit further includes a means for providing rigid support of the hollow chamber coupled to the handle means.

Another embodiment of the present invention includes providing a kit for a crevice cleaning tool. The method consists of providing a plate member having an aperture extending from a bottom face to a top face; providing a blade member adapted to arrange about perpendicular to the bottom face; and providing a conduit means adapted to couple to the plate and adapted to provide a fluid flow path from the aperture. This method further includes providing a leading blade edge having about a 45-degree slope relative to the bottom face. And, the method includes the step of providing a handle means adapted to couple to the conduit means. Further, the method includes providing a rolling element adapted to arrange on the plate.

Although the invention has been particularly shown and described with reference to certain embodiments, it will be understood by those skilled in the art that various changes in form and detail may be made without departing from the spirit and scope of the invention.

I claim:

1. A deck-crevice cleaning tool adapted to connect to a shop vacuum, the tool comprising:

a single, rigid blade member adapted to fit in a deck crevice to enable dislodging of debris-build up disposed in the deck crevice and the blade member being arranged generally parallel with a direction of the tool to arrange in an elongated crevice;

a plate member coupled to the blade member, the plate member arranged to perpendicularly dispose the blade member to a bottom face of the plate, the plate member further comprising an aperture extending from the bottom face to an oppositely arranged top face whereby the aperture aligns over at least a portion of the blade so that debris dislodged by the blade is forced upward into the aperture;

a conduit member coupled to the plate, the conduit further comprising a hollow chamber extending from a proximal end to a distal end, the chamber being arranged in fluid connection with the aperture;

a means for selectively coupling the conduit member to a hose provided by the shop vacuum whereby suction generated by the shop vacuum is in fluid connection with the coupling means, the hollow chamber and the aperture and being enabled to cause dislodged debris to flow from the blade to the shop vacuum; and an acutely sloped leading blade edge arranged whereby a top portion of the leading blade edge overlaps a portion of the aperture.

2. The deck-crevice cleaning tool of claim 1 wherein the blade further comprises:

a leading blade edge arranged at about a 45-degree angle relative to a to a bottom edge of the blade and wherein a portion of the blade edge overlaps a portion of the aperture.

3. The deck-crevice cleaning tool of claim 1 further comprising:

a rolling element disposed adjacent to the bottom face and adapted to enable the tool to travel along the deck whereby the blade inserts in a deck crevice.

4. A crevice cleaning tool comprising:

a single rigid blade member disposed generally perpendicular to a bottom face of a plate member and the blade member being arranged generally parallel with a direction of travel of the tool to arrange in an elongated crevice; the plate member comprising an aperture creating a fluid-flow path from the bottom face to a top face;

a conduit member comprising a side wall and oppositely arranged and open distal and proximal ends to form a hollow chamber, the proximal end coupled to the plate and the hollow chamber further adapted to extend the fluid-flow path from the plate from the proximal end to the distal end; and an acutely sloped leading blade edge arranged whereby a top portion of the leading blade edge overlaps a portion of the aperture.

5. The crevice cleaning tool of claim 4 wherein the conduit member further comprises:

a means for providing rigid support of the hollow chamber.

6. The crevice cleaning tool of claim 4 wherein the conduit member further comprises:

a handle means for gripping the tool, the handle means arranged adjacent to the distal end;

a means for providing rigid support of the hollow chamber coupled to the handle means.

7. The crevice cleaning tool of claim 4 wherein the blade further comprises:

an acutely sloped leading blade edge arranged whereby a top portion of the leading blade edge overlaps a portion of the aperture.

8. The crevice cleaning tool of claim 4 wherein the blade further comprises: a leading blade edge arranged at about a 45-degree angle relative to a to a bottom edge of the blade and wherein a portion of the blade edge overlaps a portion of the aperture.

9. The crevice cleaning tool of claim 4 wherein the aperture arranged on the top face of the plate couples to a corresponding opening on the bottom face by means of a sidewall having about a 45-degree angle relative to a plane defined by the bottom face.

10. The crevice cleaning tool of claim 4 further comprising:

a rolling element disposed adjacent to the bottom face.

11. A method of cleaning a deck comprising:

providing a deck-cleaning tool kit, the deck-cleaning tool kit including a plate member having an aperture extending from a bottom face to a top face, a blade member adapted to arrange about perpendicular to the bottom face and the blade member being arranged generally parallel with a direction of travel of the tool to arrange in an elongated crevice, a conduit member adapted to couple to the plate and adapted to provide a fluid flow path from the aperture, and an acute sloped leading blade edge arranged whereby a top portion of the leading blade edge overlaps a portion of the aperture; and providing a vacuum and coupling the vacuum to the conduit member; and using the deck-cleaning tool kit to clean a deck.

12. The method of claim 11 wherein:

the deck-cleaning tool kit further includes a leading blade edge having about a 45-degree slope relative to the bottom face, the leading blade coupled to the plate member.

13. The method of claim 11 wherein:

the deck-cleaning tool kit further includes a handle means adapted to couple to the conduit member and positioned intermediate to the conduit member and the vacuum.

14. The method of claim 11 wherein:

the deck-cleaning tool kit further includes at least one rolling element adapted to arrange on the plate.

15. The crevice cleaning tool of claim 4 wherein:

the aperture arranged on top face of the plate couples to a corresponding opening on the bottom face by means of a sidewall having from about a 21-degree angle to about a 23-degree angle relative to a plane defined by the bottom face.

* * * * *